US009089858B2

(12) United States Patent
Hung

(10) Patent No.: US 9,089,858 B2
(45) Date of Patent: Jul. 28, 2015

(54) UNDERGROUND LIFTABLE LOW-FLOW SPRINKLER

(71) Applicant: PLASTICO CORPORATION, Taipei (TW)

(72) Inventor: Shih-Min Hung, Taipei (TW)

(73) Assignee: Plastico Corporation, Taipei (TW)

( * ) Notice: Subject to any disclaimer, the term of this patent is extended or adjusted under 35 U.S.C. 154(b) by 314 days.

(21) Appl. No.: 13/744,888

(22) Filed: Jan. 18, 2013

(65) Prior Publication Data

US 2014/0203105 A1 Jul. 24, 2014

(51) Int. Cl.

| | |
|---|---|
| ***B05B 3/00*** | (2006.01) |
| ***B05B 3/08*** | (2006.01) |
| ***B05B 3/06*** | (2006.01) |
| ***B05B 3/04*** | (2006.01) |
| ***B05B 1/28*** | (2006.01) |
| ***B05B 15/10*** | (2006.01) |
| ***B05B 3/02*** | (2006.01) |
| ***B05B 3/16*** | (2006.01) |
| ***B05B 1/26*** | (2006.01) |
| ***B05B 1/08*** | (2006.01) |
| ***B05B 1/16*** | (2006.01) |
| ***B05B 3/10*** | (2006.01) |
| ***B05B 15/00*** | (2006.01) |

(52) U.S. Cl.

CPC ..... *B05B 1/16* (2013.01); *B05B 3/0481* (2013.01); *B05B 3/1057* (2013.01); *B05B 15/001* (2013.01); *B05B 15/10* (2013.01)

(58) Field of Classification Search

CPC ..... B05B 1/16; B05B 3/1057; B05B 15/10; B05B 3/0481; B05B 15/001; B05B 3/06

USPC ..... 239/206, 200, 201, 203, 204, 205, 214, 239/222.11, 222.13, 225.1, 230, 231, 232, 239/233, 237, 242, 246, 251, 253, 261, 263, 239/288, 288.3, 380–389, 461, 505, 518, 239/589.1, 590, 600, DIG. 1

See application file for complete search history.

(56) References Cited

U.S. PATENT DOCUMENTS

| | | | | | |
|---|---|---|---|---|---|
| 3,063,645 | A | * | 11/1962 | Tropeano et al. | 239/206 |
| 3,086,714 | A | * | 4/1963 | Tropeano et al. | 239/206 |
| 3,088,677 | A | * | 5/1963 | Coffey et al. | 239/205 |
| 3,104,822 | A | * | 9/1963 | Muschett | 239/206 |
| 3,268,173 | A | * | 8/1966 | Costa | 239/206 |
| 3,301,489 | A | * | 1/1967 | Tropeano et al. | 239/206 |
| 3,434,664 | A | * | 3/1969 | Friedmann et al. | 239/206 |

(Continued)

*Primary Examiner* — Jason Boeckmann
*Assistant Examiner* — Steven M Cernoch
(74) *Attorney, Agent, or Firm* — Rosenberg, Klein & Lee

(57) ABSTRACT

The invention relates to an underground liftable low-flow sprinkler comprises: a subterranean cylindrical housing arranged under the ground and having a first and second containing room with different diameter and a lifting tube being storable in the first containing room and a low-flow sprinkler being storable in the second containing room. The low-flow sprinkler provides a screw tube screwing on an upper end of the lifting tube for lifting together. When the water is sent into a water inlet, the lifting tube in the first containing room is moved upward by water force. The low-flow sprinkler then extends out from the second containing room and the water flows through a nozzle, swinging base and other components to circularly sprinkle an annular region. The present invention has low flow and uniform sprinkle characteristics to achieve an ease of use and water conservation effects.

4 Claims, 7 Drawing Sheets

(56) References Cited

U.S. PATENT DOCUMENTS

| | | | | | |
|---|---|---|---|---|---|
| 3,625,429 | A | * | 12/1971 | Turrell | 239/206 |
| 3,758,038 | A | * | 9/1973 | Ridgway | 239/206 |
| 3,791,581 | A | * | 2/1974 | Chow | 239/205 |
| 3,977,063 | A | * | 8/1976 | Bruninga | 29/890.143 |
| 4,010,901 | A | * | 3/1977 | Sheets | 239/204 |
| 4,014,502 | A | * | 3/1977 | Sheets | 239/206 |
| 4,103,828 | A | * | 8/1978 | Ridgway | 239/206 |
| 4,113,181 | A | * | 9/1978 | Sheets | 239/206 |
| 4,145,003 | A | * | 3/1979 | Harrison et al. | 239/288 |
| 4,316,579 | A | * | 2/1982 | Ray et al. | 239/123 |
| 4,432,495 | A | * | 2/1984 | Bruninga | 239/205 |
| 4,448,353 | A | * | 5/1984 | Livne | 239/205 |
| 4,616,780 | A | * | 10/1986 | Abbott | 239/113 |
| 4,753,391 | A | * | 6/1988 | Rogers | 239/203 |
| 4,760,959 | A | * | 8/1988 | Gorney | 239/233 |
| 4,763,839 | A | * | 8/1988 | Greenberg | 239/222.17 |
| 4,781,327 | A | * | 11/1988 | Lawson et al. | 239/203 |
| 4,805,838 | A | * | 2/1989 | Greenberg | 239/222.17 |
| 5,267,689 | A | * | 12/1993 | Forer | 239/11 |
| 5,372,307 | A | * | 12/1994 | Sesser | 239/210 |
| 5,544,814 | A | * | 8/1996 | Spenser | 239/241 |
| 5,671,886 | A | * | 9/1997 | Sesser | 239/222.21 |
| 5,871,156 | A | * | 2/1999 | Lawson | 239/201 |
| 5,971,297 | A | * | 10/1999 | Sesser | 239/222.21 |
| 6,095,432 | A | * | 8/2000 | Casagrande | 239/230 |
| 6,142,386 | A | * | 11/2000 | Spenser | 239/222.11 |
| 6,155,493 | A | * | 12/2000 | Kearby et al. | 239/205 |
| 6,439,476 | B1 | * | 8/2002 | Boggs | 239/203 |
| 6,494,384 | B1 | * | 12/2002 | Meyer | 239/222.11 |
| 6,530,531 | B2 | * | 3/2003 | Butler | 239/205 |
| 6,651,904 | B2 | * | 11/2003 | Roman | 239/204 |
| 7,097,116 | B2 | * | 8/2006 | Fernandez | 239/206 |
| 7,216,817 | B2 | * | 5/2007 | Turk et al. | 239/230 |
| 7,954,731 | B2 | * | 6/2011 | Antonucci et al. | 239/230 |
| 8,079,531 | B2 | * | 12/2011 | Katzman et al. | 239/204 |
| 8,083,158 | B2 | * | 12/2011 | Katzman et al. | 239/204 |
| 2003/0071140 | A1 | * | 4/2003 | Roman | 239/205 |
| 2004/0262426 | A1 | * | 12/2004 | Antonucci et al. | 239/233 |
| 2005/0011970 | A1 | * | 1/2005 | Fernandez | 239/205 |
| 2006/0108445 | A1 | * | 5/2006 | Pinch et al. | 239/222.21 |
| 2007/0095935 | A1 | * | 5/2007 | Katzman et al. | 239/204 |
| 2008/0164341 | A1 | * | 7/2008 | Katzman et al. | 239/205 |
| 2011/0024523 | A1 | * | 2/2011 | Sesser et al. | 239/205 |

* cited by examiner

UNDERGROUND LIFTABLE LOW-FLOW SPRINKLER

BACKGROUND OF THE INVENTION

1. Field of the Invention

The invention relates to a rotary sprinkler, particularly to an underground liftable low-flow sprinkler.

2. Description of the Related Art

Since the 1930s, the rotary sprinkler has been applied for the allocation of water in agricultural irrigation. Such type of patent includes U.S. Pat. Nos. 4,760,959, 4,402,460, 4,182,494, 3,955,762 and 3,022,012.

These conventional sprinklers belong to a kind of impact drive sprinkler 10 as shown in FIG. 1, comprising: a rotary shaft 11, sprinkler body 12, a nozzle 13, an impact arm 14, a reaction member 15 and a cover plate 16. The impact drive sprinkler 10 enables to circularly sprinkle an annular region. U.S. Pat. Nos. 4,182,494 and 4,760,959 further disclose an underground subterranean cylindrical housing 17 for lifting and storing the impact drive sprinkler 10.

It is found that when the conventional impact drive sprinkler 10 sprinkles, the rotation angle of the impact drive sprinkler 10 is different due to the different water pressure of the faucet, resulting in an uneven distribution of sprinkle. Moreover, the impact drive sprinkler 10 requires high water flow and high water pressure for rising up to the ground and sprinkling; therefore, it may be a waste of water resource if the high water flow does not evenly be distributed.

SUMMARY OF THE INVENTION

It is a primary object of the present invention to provide, which provides a low-flow sprinkler usually stored under the ground to save space and the impact of water enables the low-flow sprinkler to automatically rise above the ground to sprinkle, achieving low flow and uniform sprinkle effects.

In order to achieve the above object, the underground liftable low-flow sprinkler comprises: a subterranean cylindrical housing being a hollow barrel body and having a bottom portion as a first water inlet, the first water inlet upward connected to a first containing room, the first containing room upward connected to the second containing room with a larger diameter, the first containing room forming a first screw at an inner edge of an upper opening thereof and the second containing room having a lifting aperture at a top surface thereof; a lifting tube being storable in the first containing room and having a bottom end as a second water inlet with a larger diameter than the first water inlet, the second water inlet including a flange at an external periphery thereof, the lifting tube having a middle section being a non-circular tube and an inner edge of an upper end forming a second screw; a spring mounted on an external periphery of the lifting tube and having a bottom end mounting on the flange; a hollow positioning cover having a lower section as a screw thread for screwing on the first screw, a middle section forming a radial convex ring for suppressing on an upper edge of the first screw and an upper section being a non-circular aperture; a stop valve sleeve mounted at an inner edge of the hollow positioning cover, a bottom inner edge thereof suppressed on an upper end of the spring and an inner wall thereof having a non-circular hole corresponding to an external diameter of the lifting tube for the lifting tube to be extended out from the non-circular aperture; and a low-flow sprinkler being storable in the second containing room, including: a support having a bottom plate, a plurality of ribs at a periphery of the bottom plate for supporting a ring and a tubular passage at a middle thereof, a screw tube forming below the tubular passage and extending from a bottom edge of the bottom plate for screwing on the second screw; a first nozzle arranged in the screw tube: a rotation core base having a hollow body with an opening at a side thereof, a fin upward extending from a side thereof and an outlet on a top thereof; a second nozzle pressed into the hollow body; a rotation core having a bottom end mounted on the outlet; a radial bearing plate inserted into a rectangular hole at a lower side of the hollow body; a swinging base having an annular disc and a core sleeve at a middle thereof for the rotation core inserting in, a through hole provided at a side of the core sleeve for the fin of the rotation core base extending through; a third nozzle having an end connected to the second nozzle and another end connected to an outer side of the annular disc; a torsional spring arranged at an external periphery of the core sleeve; a rotation shaft mounted on the torsional spring and the core sleeve, corresponding to the fin having a joint groove for inserting the fin and a positioning hole provided at middle of a top surface of the rotation shaft; and a cover plate arranged on the rotation shaft and an external diameter thereof being storable in the lifting aperture of the second containing room to form a low-flow sprinkler.

Whereby, the low-flow sprinkler provides the screw tube screwing on an upper end of the lifting tube for lifting together. When the water is sent into the water inlet, the lifting tube in the first containing room is moved upward by water force. The low-flow sprinkler then extends out from the second containing room and the water flows through the first, second and third nozzles to instantly drive the swinging base to counterclockwise rotate and sprinkle water. When the third nozzle sprinkles water and the reaction force is reduced, the torsional spring begins to release elastic force for the swinging base moving back to the original position to conduct a low-flow sprinkle with circular rotation of an annular region.

DETAILED DESCRIPTION OF THE PREFERRED EMBODIMENT

Figure 1:
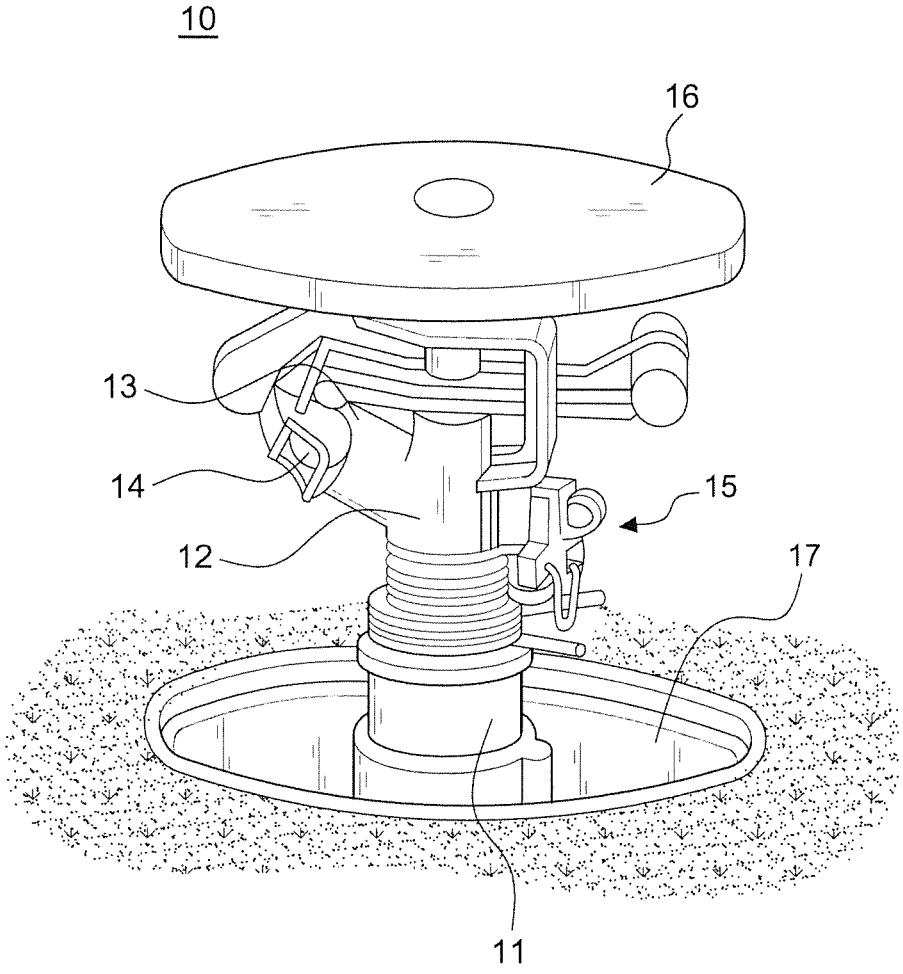
FIG.1 PRIOR ART
FIG. 1 is a schematic view of a conventional impact sprinkler.
Figure 2:
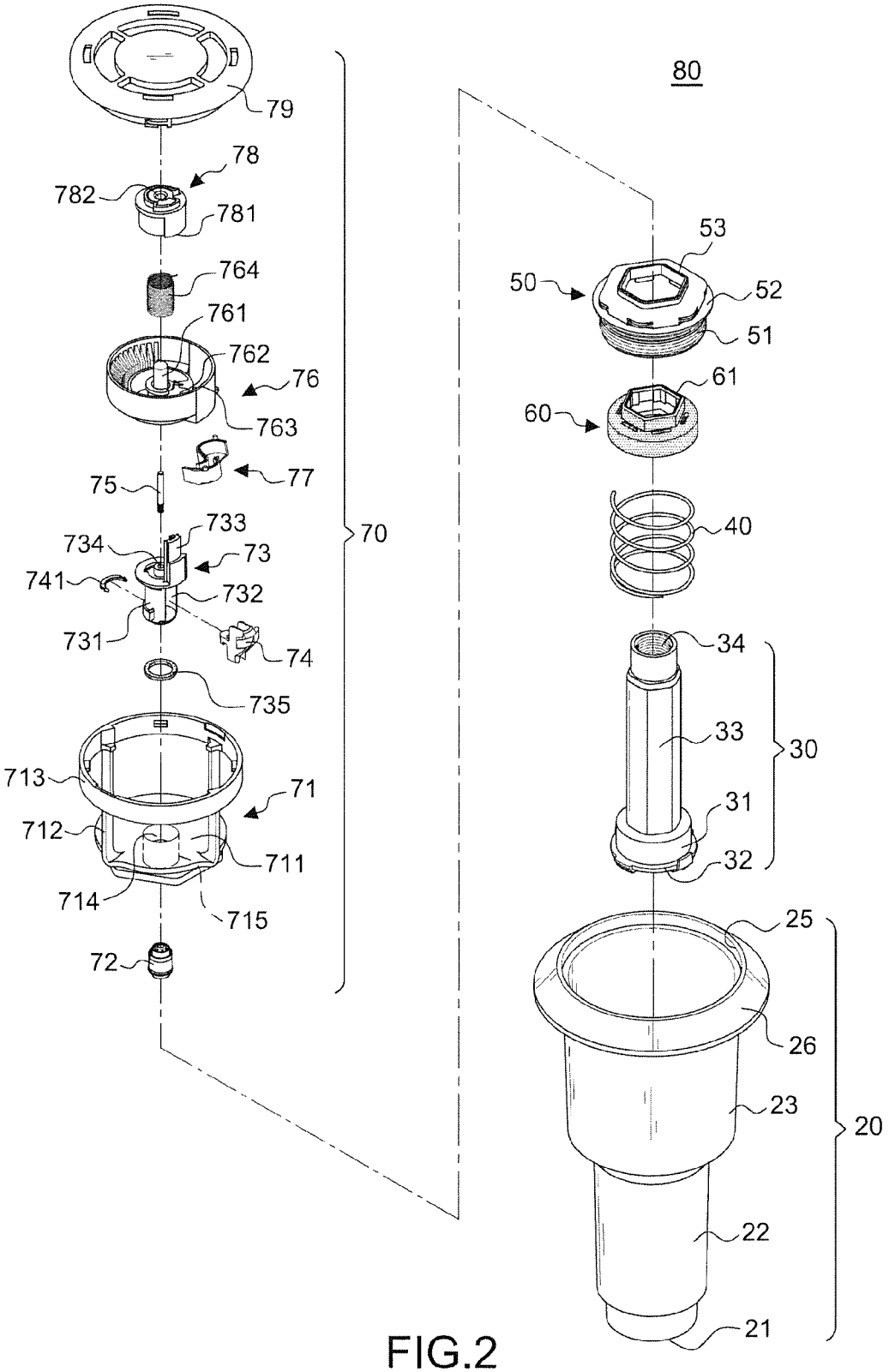
FIG. 2 is an exploded elevational view of the present invention.
Figure 3:
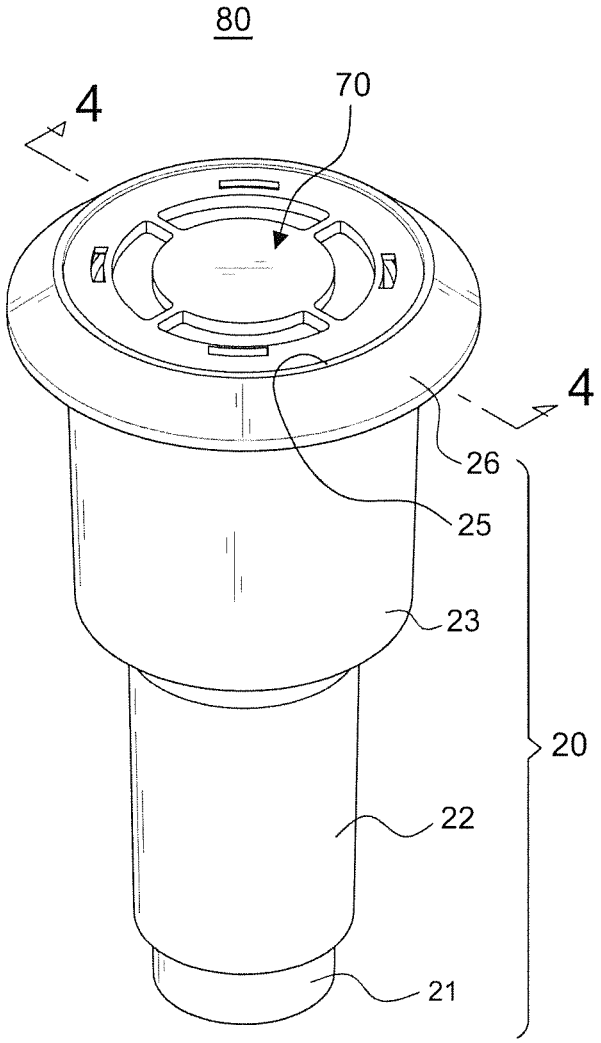
FIG. 3 is an elevational view of the present invention, illustrating the low-flow sprinkler moving downward.
Figure 7:
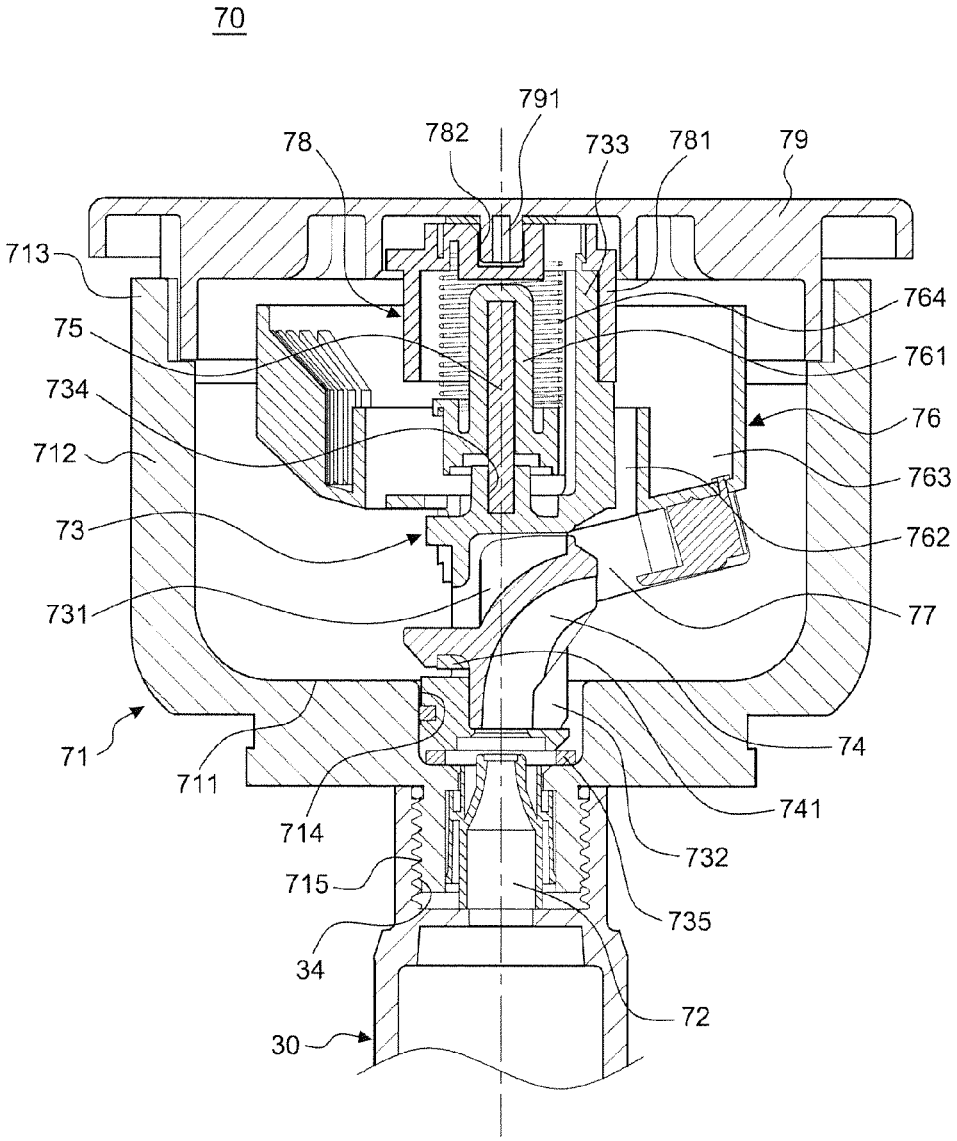
FIG. 7 is an enlarged sectional view of the low-flow sprinkler in accordance with the present invention.

Referring to FIGS. 2 and 7, the preferred embodiment of a liftable low-flow sprinkler 80 in accordance with the present invention comprises: a subterranean cylindrical housing 20, a lifting tube 30, a spring 40, a hollow positioning cover 50 and a stop valve sleeve 60.

The subterranean cylindrical housing 20 is a hollow barrel body and has a bottom portion as a first water inlet 21. The first water inlet 21 is upward connected to a first containing room 22 and the first containing room 22 is upward connected to the second containing room 23 with a larger diameter. The first containing room 22 has a first screw 24 at an inner edge of an upper opening thereof and the second containing room 23 has a lifting aperture 25 at a top surface thereof.

The lifting tube 30 is storable in the first containing room 22 and has a bottom end as a second water inlet 31 with a larger diameter than the first water inlet 21. The second water inlet 31 includes a flange 32 at an external periphery thereof. The lifting tube 30 has a middle section being a non-circular tube 33 and an inner edge of an upper end forming a second screw 24. In this embodiment, the lifting tube 30 is a hexagon but it is not a limitation.

The spring 40 is mounted on an external periphery of the lifting tube 30 and has a bottom end mounting on the flange 32. The hollow positioning cover 50 has a lower section as a screw thread 51 for screwing on the first screw 24, a middle section forming a radial convex ring 52 for suppressing on an upper edge of the first screw 24 and an upper section being a non-circular aperture 53.

The stop valve sleeve 60 is mounted at an inner edge of the hollow positioning cover 50; a bottom inner edge thereof is suppressed on an upper end of the spring 40 and an inner wall thereof has a non-circular hole 61 corresponding to an external diameter of the lifting tube 30 for the lifting tube 30 to be extended out from the non-circular aperture 53.

The above-disclosed elements are arranged in the subterranean cylindrical housing 20 for the lifting tube 30 to be moved up by the flow force of the water. When the water stops flowing, the spring 40 enables the lifting tube 30 to move down and back to the original place.

Referring to FIGS. 2 and 7, the present invention further provides a low-flow sprinkler 70 which is storable in the subterranean cylindrical housing 20 and comprises: a support 71, a first nozzle 72, a rotation core base 73, a second nozzle 74, a rotation core 75, a swinging base 76, a third nozzle 77, a rotation shaft 78 and a cover plate 79.

The support 71 has a bottom plate 711, a plurality of ribs 712 at a periphery of the bottom plate 711 for supporting a ring 713 and a tubular passage 714 at middle thereof. A screw tube 715 is formed below the tubular passage 714 and extended from a bottom edge of the bottom plate 711 for screwing on the second screw 34.

The first nozzle 72 is arranged in the screw tube 715. The rotation core base 73 has a hollow body 731 with an opening 732 at a side thereof, a fin 733 upward extending from a side thereof and an outlet 734 on a top thereof. The rotation core 75 has a bottom end mounted on the outlet 734. In the embodiment, the rotation core base 73 has a friction pad 735 at a bottom end thereof.

The second nozzle 74 is pressed into the hollow body 731 and a radial bearing plate 741 is inserted into a rectangular hole at a lower side of the hollow body 731.

The swinging base 76 has an annular disc 763 and a core sleeve 761 at middle thereof for the rotation core 75 inserting in and a through hole 762 is provided at a side of the core sleeve 761 for the fin 733 of the rotation core base 73 extending through. The third nozzle 77 in an S-shaped has an end connected to the second nozzle 74 and another end connected to an outer side of the annular disc 763. A torsional spring 764 is arranged at an external periphery of the core sleeve 761 and a rotation shaft 78 is mounted on the torsional spring 764 and the core sleeve 761. The rotation shaft 78 corresponding to the fin 733 has a joint groove 781 for inserting the fin 733 and the rotation shaft 78 further has a positioning hole 782 at middle of a top surface thereof.

The cover plate 79 is arranged on the rotation shaft 78. In the embodiment, the cover plate 79 has a convex body 791 at a bottom edge thereof for inserting into the positioning hole 782. The cover plate 79 further has an external diameter being storable in the lifting aperture 25 of the second containing room 23 to form a low-flow sprinkler 70.

Figure 6:
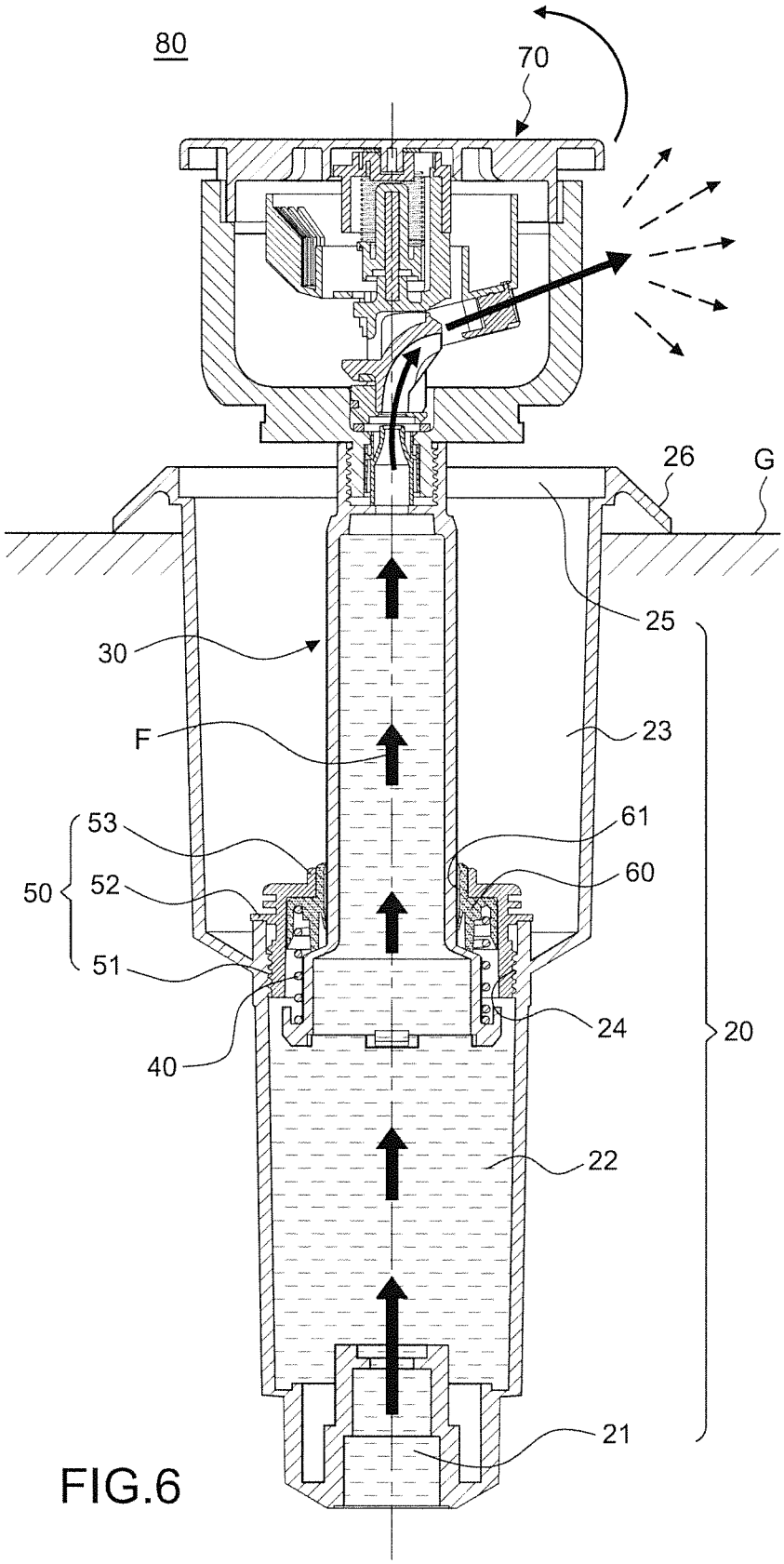
FIG. 6 is a cross-section view of the present invention taken along line 6-6 of FIG. 5.

Based on the features disclosed, the low-flow sprinkler 70 provides the screw tube 715 screwing on an upper end of the lifting tube 30 for lifting together. With the reference to FIG. 6, when the water is sent into the water inlet 21, the lifting tube 30 in the first containing room 22 is moved upward by a water force F which is greater than an elastic force of the spring 40. The low-flow sprinkler 70 then extends out from the second containing room 23 and the water flows through the first, second and third nozzle 72, 74, 77 to instantly drive the swinging base 76 to counterclockwise rotate and sprinkle water. When the third nozzle 77 sprinkles water and the reaction force is reduced, the torsional spring 764 begins to release elastic force for the swinging base 76 moving back to the original position to conduct a low-flow sprinkle with circular rotation of an annular region.

Figure 4:
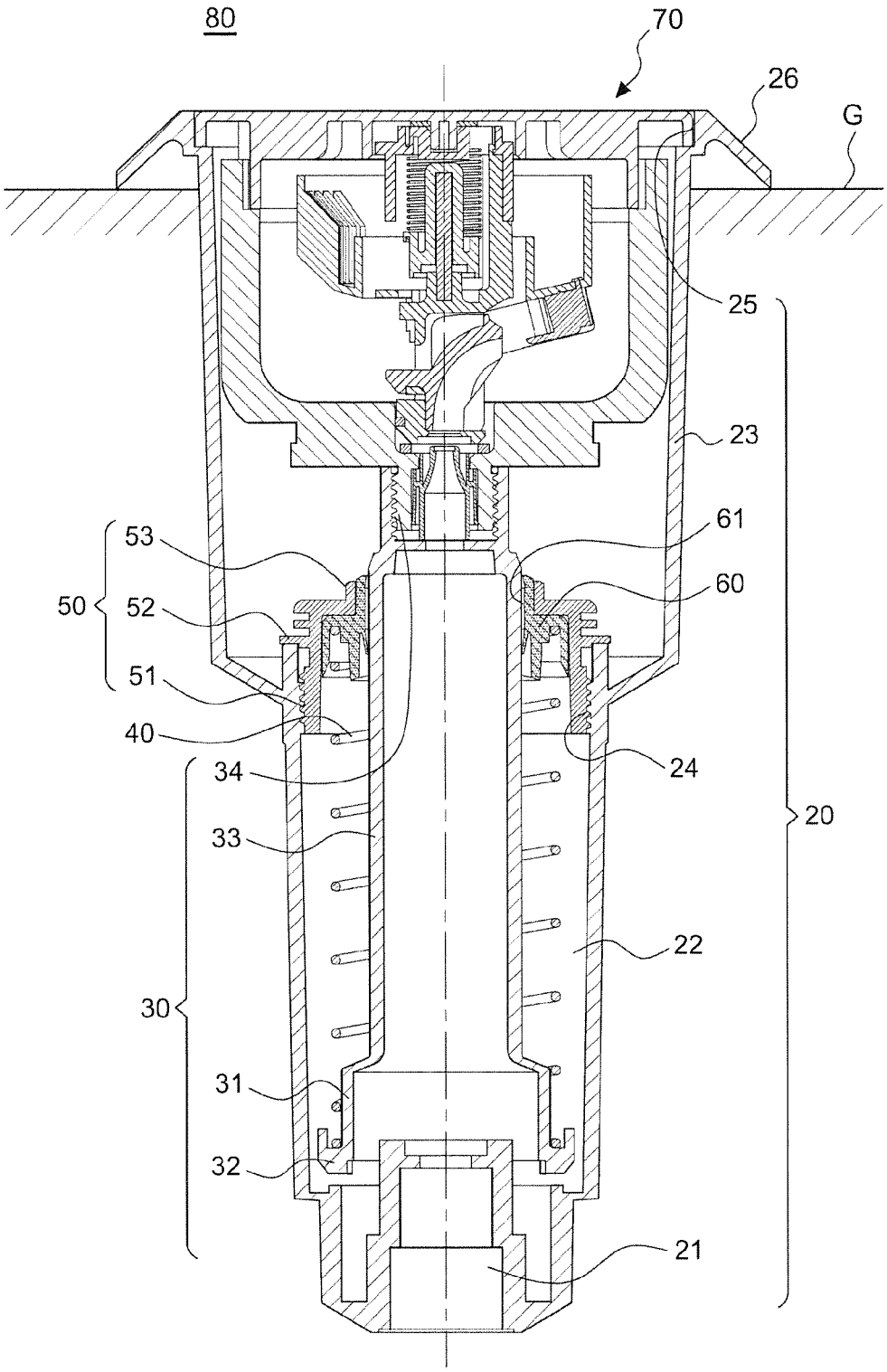
FIG. 4 is a cross-section view of the present invention taken along line 4-4 of FIG. 3.
Figure 5:
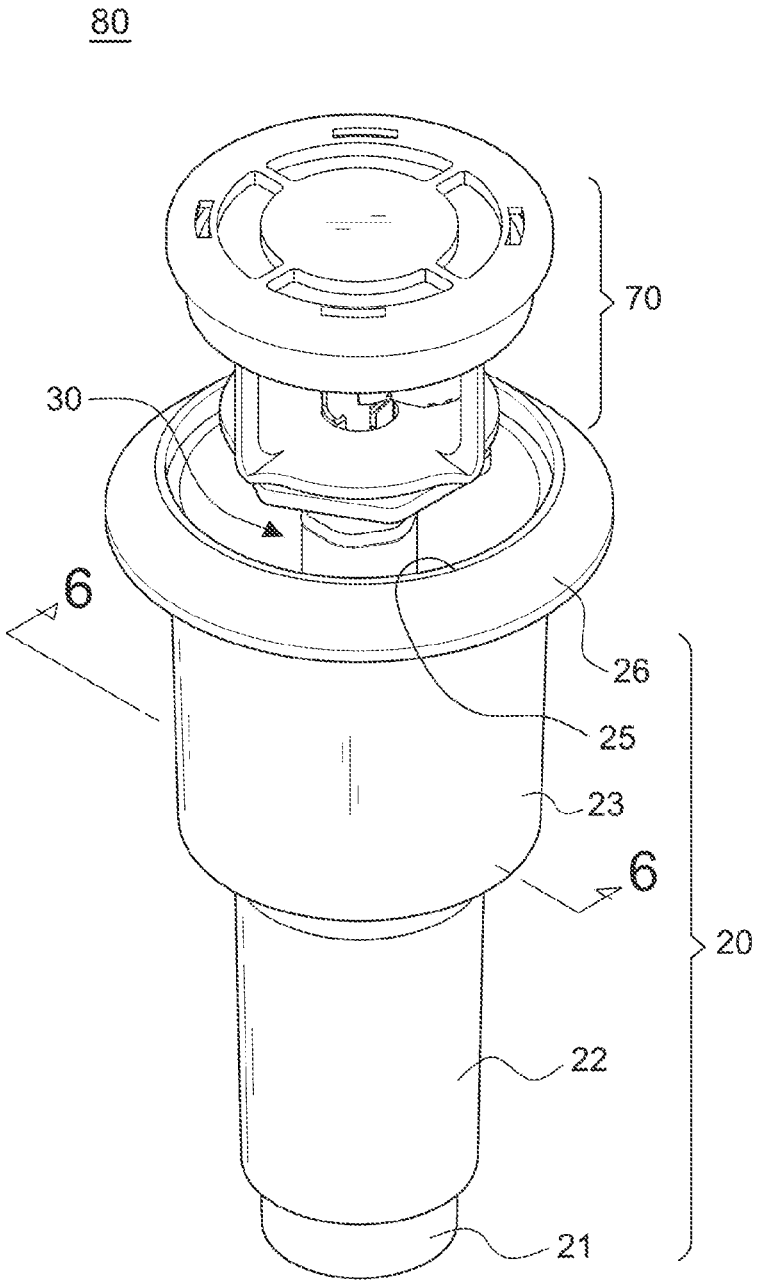
FIG. 5 is an elevational view of the present invention, illustrating the low-flow sprinkler moving upward.

With the reference to FIG. 4, when the water stops flowing, the lifting tube 30 is moved down by the elastic force of the spring 40 and the low-flow sprinkler 70 is also moved into the second containing room 23 for the subterranean cylindrical housing 20 to be moved under the ground G. In the embodiment, an external periphery of a lifting aperture 25 of the second containing room 23 is an annular cone surface. Moreover, when the low-flow sprinkler 70 is stored in the second containing room 23, the cover plate 79 is flush with the lifting aperture 25 of the second containing room 23.

Comparing to the conventional impact drive sprinkler 10, the present invention has low flow and uniform sprinkle characteristics. Moreover, the present invention provides a low-flow sprinkler 70 in the subterranean cylindrical housing 20 usually stored under the ground G to save space. When using the present invention, the impact of water enables the low-flow sprinkler 70 to automatically rise above the ground to sprinkle, achieving ease of use and water conservation effects.

What is claimed is:

1. An underground liftable low-flow sprinkler, comprising:

a subterranean cylindrical housing being a hollow barrel body and having a bottom portion as a first water inlet, the first water inlet upward connected to a first containing room, the first containing room upward connected to the second containing room with a larger diameter, the first containing room forming a first screw at an inner edge of an upper opening thereof and the second containing room having a lifting aperture at a top surface thereof;

a lifting tube being storable in the first containing room and having a bottom end as a second water inlet with a larger diameter than the first water inlet, the second water inlet including a flange at an external periphery thereof, the lifting tube having a middle section being a non-circular tube and an inner edge of an upper end forming a second screw;

a spring mounted on an external periphery of the lifting tube and having a bottom end mounting on the flange;

a hollow positioning cover having a lower section as a screw thread for screwing on the first screw, a middle section forming a radial convex ring for suppressing on an upper edge of the first screw and an upper section being a non-circular aperture;

a stop valve sleeve mounted at an inner edge of the hollow positioning cover, a bottom inner edge thereof suppressed on an upper end of the spring and an inner wall thereof having a non-circular hole corresponding to an external diameter of the lifting tube for the lifting tube to be extended out from the non-circular aperture;

a low-flow sprinkler being storable in the second containing room, including:

a support having a bottom plate, a plurality of ribs at a periphery of the bottom plate for supporting a ring and a tubular passage at a middle thereof, a screw tube forming below the tubular passage and extending from a bottom edge of the bottom plate for screwing on the second screw;

a first nozzle arranged in the screw tube:

a rotation core base having a hollow body with an opening at a side thereof, a fin upward extending from a side thereof and an outlet on a top thereof;

a second nozzle pressed into the hollow body;

a rotation core having a bottom end mounted on the outlet;

a radial bearing plate inserted into a rectangular hole at a lower side of the hollow body;

a swinging base having an annular disc and a core sleeve at a middle thereof for the rotation core inserting in, a through hole provided at a side of the core sleeve for the fin of the rotation core base extending through;

a third nozzle having an end connected to the second nozzle and another end connected to an outer side of the annular disc;

a torsional spring arranged at an external periphery of the core sleeve;

a rotation shaft mounted on the torsional spring and the core sleeve, corresponding to the fin having a joint groove for inserting the fin and a positioning hole provided at middle of a top surface of the rotation shaft; and a cover plate arranged on the rotation shaft and an external diameter thereof being storable in the lifting aperture of the second containing room to form a low-flow sprinkler;

whereby, the low-flow sprinkler provides the screw tube screwing on an upper end of the lifting tube for lifting together; when the water is sent into the water inlet, the lifting tube in the first containing room is moved upward by water force; the low-flow sprinkler then extends out from the second containing room and the water flows through the first, second and third nozzle to instantly drive the swinging base to counterclockwise rotate and sprinkle water; when the third nozzle sprinkles water and the reaction force is reduced, the torsional spring begins to release elastic force for the swinging base moving back to the original position to conduct a low-flow sprinkle with circular rotation of an annular region.

2. The underground liftable low-flow sprinkler as claimed in claim 1, wherein the subterranean cylindrical housing is placed underground and an external periphery of the lifting aperture of the second containing room is an annular cone surface.

3. The underground liftable low-flow sprinkler as claimed in claim 1, wherein the rotation core base has a friction pad at a bottom end thereof.

4. The underground liftable low-flow sprinkler as claimed in claim 1, wherein the cover plate is flush with the lifting aperture of the second containing room when the low-flow sprinkler is stored in the second containing room.

* * * * *